US006009819A

United States Patent [19]

Sahl

[11] Patent Number: 6,009,819

[45] Date of Patent: Jan. 4, 2000

[54] AUXILIARY DEVICE FOR SEWING UP THE STARTING END OF A THREAD CHAIN IN A CHAIN STITCH SEWING MACHINE

[75] Inventor: Johannes Sahl, Neuhofen, Austria

[73] Assignee: Nahtechnik Sahi Ges. m.b.H., Neuhofen, Austria

[21] Appl. No.: 09/084,642

[22] Filed: May 26, 1998

[30] Foreign Application Priority Data

May 30, 1997 [AT] Austria ..... A 922/97

[51] Int. Cl.[7] ..... D05B 37/04; D05B 35/10; D05B 65/00

[52] U.S. Cl. ..... 112/197; 112/253; 112/288

[58] Field of Search ..... 112/197, 288, 112/260, 253, 130

[56] References Cited

U.S. PATENT DOCUMENTS

| | | | |
|---|---|---|---|
| 4,220,105 | 9/1980 | Palacino . | |
| 4,356,782 | 11/1982 | Ueyama et al. | 112/197 |
| 4,796,552 | 1/1989 | Adamsi, Jr. | 112/253 X |
| 5,090,343 | 2/1992 | Nishiura et al. | 112/130 |

*Primary Examiner*—Ismael Izaguirre
*Attorney, Agent, or Firm*—Collard & Roe, P.C.

[57] ABSTRACT

An auxiliary device (6) for sewing up the starting end of a thread chain (F) in a chain stitch sewing machine (1) having a platform (2), a needle plate (3) and an edge cutter (4) comprises a suction and separating device (5) disposed subsequent to the needle plate (3) in sewing direction (N) for taking in and cutting off the thread chain (F) upon sewing a workpiece, a returning device for turning round the remaining end piece of the thread chain against the sewing direction (N), and a clamping and deflecting device disposed before the needle plate (3) in sewing direction for retaining the end piece of the thread chain turned round, and for laterally deflecting the same into the cutting area of the edge cutter (4).

To ensure a relatively simple and functionally reliable sewing up of the starting end, there is provided a thread chain looper (7) disposed before the stitch plate (3) in sewing direction (N) and constituting both the returning device and the clamping and deflecting device, which looper consists of looper nippers (8) longitudinally movable in sewing direction (N) and a nipper carrier (9) movable transverse to the sewing direction (N).

8 Claims, 3 Drawing Sheets

AUXILIARY DEVICE FOR SEWING UP THE STARTING END OF A THREAD CHAIN IN A CHAIN STITCH SEWING MACHINE

SUMMARY OF THE INVENTION

1. Field of the Invention

This invention relates to an auxiliary device for sewing up the starting end of a thread chain in a chain stitch sewing machine having a platform, a needle plate and an edge cutter, comprising a suction and separating means disposed subsequent to the needle plate in sewing direction for taking in and cutting off the thread chain upon sewing the workpiece, a returning means for turning round the remaining end piece of the thread chain against the sewing direction, and a clamping and deflecting means disposed before the needle plate in sewing direction for retaining the end piece of the thread chain turned round and for laterally deflecting the same into the cutting area of the edge cutter.

2. Description of the Prior Art

To prevent a seam from coming undone and to achieve a proper starting end of the seam, when workpieces are sewn on a chain stitch sewing machine, the thread chain is cut through upon sewing the workpiece, the free end piece is then moved back and, upon suitably trimming the same, is sewn into the seam when sewing the next workpiece. For sewing the starting end of these thread chains on a machine there have already been provided auxiliary devices which by means of air nozzles and clamps blow over the thread chain cut through against the sewing direction and then take the same in through suction holes before the needle plate and mechanically clamp the same, where it has already been proposed that the end piece of the thread chain turned round and clamped should be drawn into the cutting area of the edge cutter by means of a transversely movable deflection means, so as to be able to shorten the end of the thread chain to be sewn in as desired. However, these known auxiliary devices are very complex and space-consuming and also susceptible to failure due to the combination of pneumatic means and mechanical clamping and shifting means.

SUMMARY OF THE INVENTION

It is therefore the object underlying the invention to eliminate these deficiencies and create an auxiliary device as described above, which with relatively little building and construction effort provides for a neat and functionally reliable sewing of the starting end of a thread chain.

This object is solved by the invention in that there is provided a thread chain looper disposed before the needle plate in sewing direction and constituting both the returning means and the clamping and deflecting means, which looper consists of looper nippers longitudinally movable in sewing direction and of a nipper carrier movable transverse to the sewing direction. This thread chain looper not only performs the function of the returning means, but also that of the clamping and deflecting means, where during the entire movement from turning round to the lateral movement and cutting into lengths, the thread chain is retained and guided in the looper nippers, so that a proper sewing up of the starting end can be achieved without a risk of failure. Upon sewing the one workpiece and cutting off the thread chain, which is then kept ready behind the needle plate by means of the existing suction and separating means, the looper need merely advance in sewing direction and seize the thread chain by means of the looper nippers, whereupon a return movement necessarily and without the assistance of compressed air or the like turns round the thread chain and brings the same into the position for sewing, so that the nipper carrier need only be moved in transverse direction so as to be able to correspondingly shorten the end of the thread chain by means of the edge cutter, and upon sewing the next the end piece of the thread chain turned round and shortened will automatically be sewn up.

A particularly expedient construction is obtained when the looper nippers include two nipper portions guided parallel to each other in longitudinal direction and adjustable relative to each other, comprising clamping edges cooperating as nipper mouth in the front end portion, which nipper portions together with the nipper mouth can be moved from a normal position lying before the needle plate to the suction hole of the suction and separating means behind the needle plate. These two nipper portions can be actuated by means of simple actuators for gripping and releasing the thread chain, and due to their longitudinal adjustment at the same time provide for returning the end of the thread chain against the sewing direction as a condition for sewing up the starting end.

When the nipper portion protruding in sewing direction defines an inclined thread deflector edge at its front end, the thread descending from the sewing needle is laterally displaced when the looper nippers move forward, which eliminates failures and prevents the thread from getting caught. Moreover, this deflector edge assists the end of the thread chain in laterally slipping into the nipper mouth.

When the nipper portions consist of leaf springs, which have been deflected downwards from the upper surface of the platform via a curved guide and act upon an actuator provided on the bottom surface of the platform, the guiding and drive members of the looper nippers can be disposed below the platform in a space-saving way, and due to the flat design of the nipper portions as leaf springs an impairment of the accessibility in the sewing area is eliminated.

In accordance with an advantageous aspect of the invention, the actuator has an adjusting disk rotatable about a horizontal transverse axis, on whose periphery the one leaf spring is mounted, where a coaxial adjusting lever pivotally mounted relative to the adjusting disk acts on the other leaf spring, which is loosely supported on the adjusting disk or on the first leaf spring. By means of simply swivelling the adjusting disk or the adjusting lever it is thus possible to shift the two leaf springs together or relative to each other and perform the desired adjusting and gripping movements.

When the nipper carrier accommodating the looper nippers is designed as horizontally guided cross slide, a transverse movement can be superimposed on the longitudinal movement of the nippers by means of the cross slide, so that the thread chain turned round can be moved into the cutting area of the laterally disposed edge cutter.

When the nipper carrier accommodating the looper nippers is designed as swivel arm pivotally mounted about a vertical axis, where a two-part swivel arm comprising a carrier portion for the looper nippers and a pivotally mounted supporting member for support on the platform may be provided, there is obtained a nipper carrier construction with a large enough range of lateral movement that can easily be adapted to the design of a sewing machine.

BRIEF DESCRIPTION OF THE DRAWING

In the drawing, the subject-matter of the invention is illustrated purely schematically, wherein.

DETAILED DESCRIPTION OF PREFERRED EMBODIMENT

Figure 1:
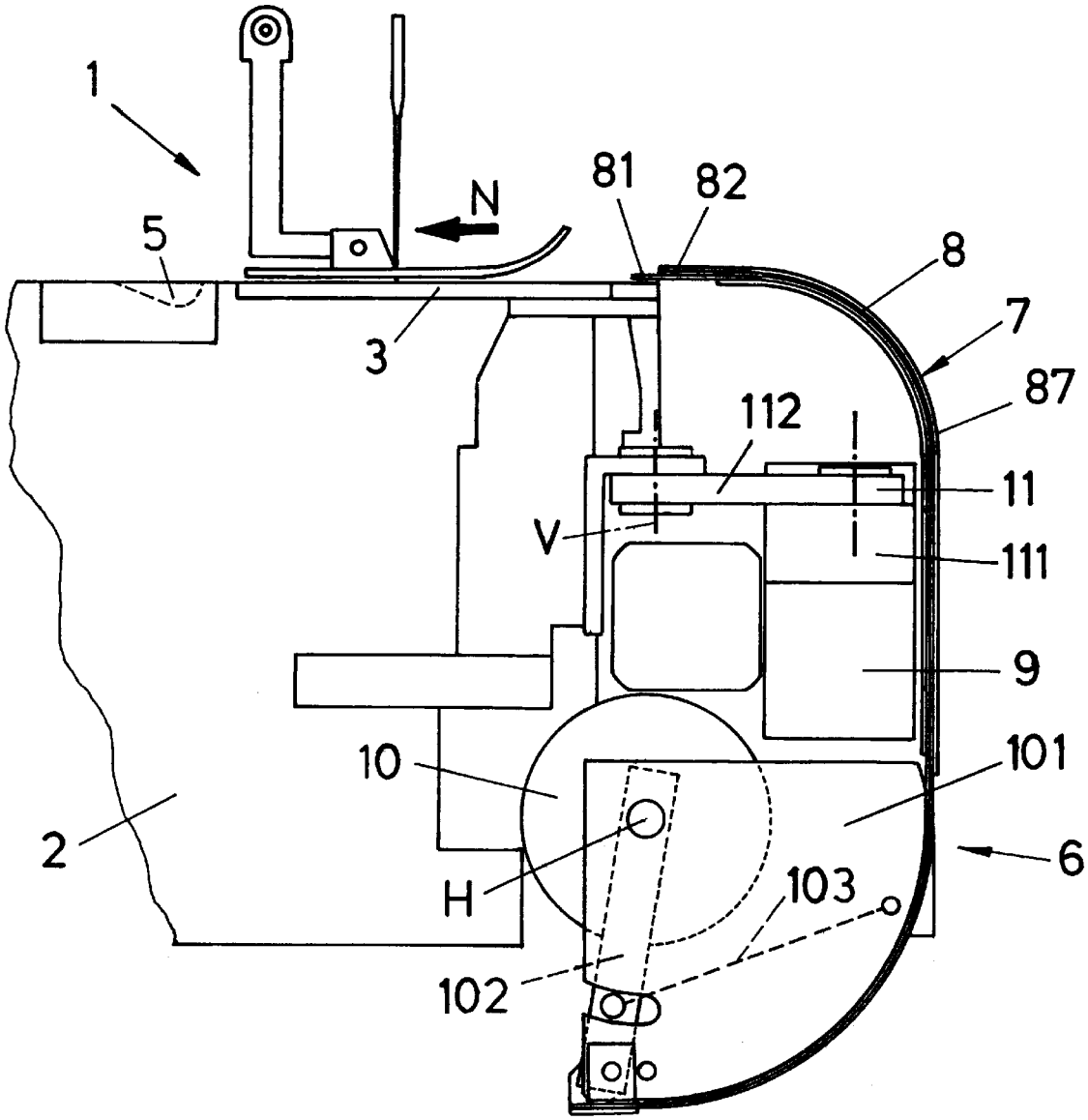
FIGS. 1, 2 and 3 represent an inventive auxiliary device in a side view, a front view and a top view.
Figure 3:
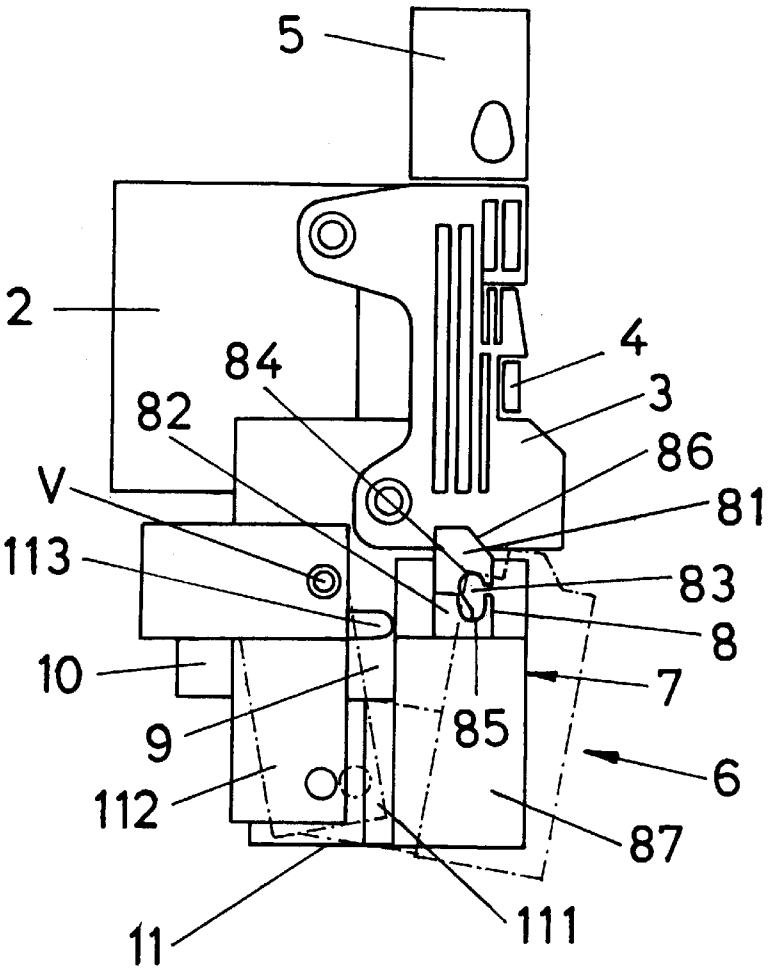
Figure 2:
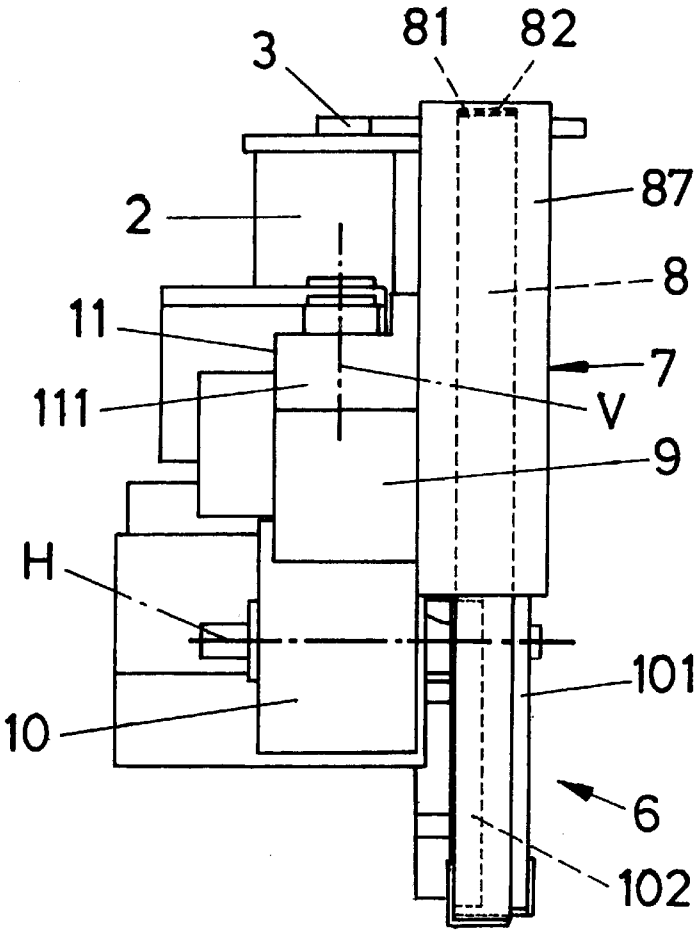

Schematically indicated chain stitch sewing machine 1 comprising a platform 2, a needle plate 3 and an edge cutter 4 as well as a suction and separating means 5 disposed subsequent to the needle plate in sewing direction for taking in and cutting off the thread chain upon sewing a workpiece is provided with an auxiliary device 6 for sewing up the starting end of a thread chain, which consists of a thread chain looper 7 disposed before the needle plate 3 in sewing direction N, which looper is composed of looper nippers 8 longitudinally movable in sewing direction and of a nipper carrier 9 movable transverse to the sewing direction N.

The looper nippers 8 comprise two nipper portions 81, 82 guided parallel to each other in longitudinal direction and adjustable relative to each other, which consist of leaf springs and in their front end portion have clamping edges 84, 85 cooperating as nipper mouth 83. In addition, the lower nipper portion 81 protruding in sewing direction defines an inclined thread deflector edge 86 at its front end. The nipper portions 81, 82 have been deflected from the upper surface of the platform towards the bottom surface via a curved guide 87 and act upon an actuator 10 comprising an adjusting disk 101 rotatable about a horizontal transverse axis H, on whose periphery the one leaf spring 81 is mounted, and a coaxial adjusting lever 102 pivotally mounted relative to the adjusting disk 101, on which acts the other, second nipper portion 82 loosely supported on the first nipper portion 81. By simply swivelling the disk 101 on the one hand and the adjusting lever 102 on the other hand it is thus possible to provide for a longitudinal adjustment of the nipper portions 81, 82 together or via an adjusting cylinder 103 relative to each other in sewing direction N, or to perform the desired nipper movements.

The nipper carrier 9 accommodating the looper nippers 8 is designed as swivel arm 11, which is supported on the platform 2 so as to be swivelled about a vertical axis V. The swivel arm has a two-part design and consists of a carrier member 111 for the looper nippers 8 and a supporting member 112 pivotally mounted thereon for supporting the same on the platform 2. By means of schematically indicated adjusting cylinder 113 the two-part spring-loaded swivel arm 11 can be swivelled open and closed in the manner of shears and thus achieve a transverse movement of the looper nippers 8.

Figures 4, 5, 6, 7, 8, 9:
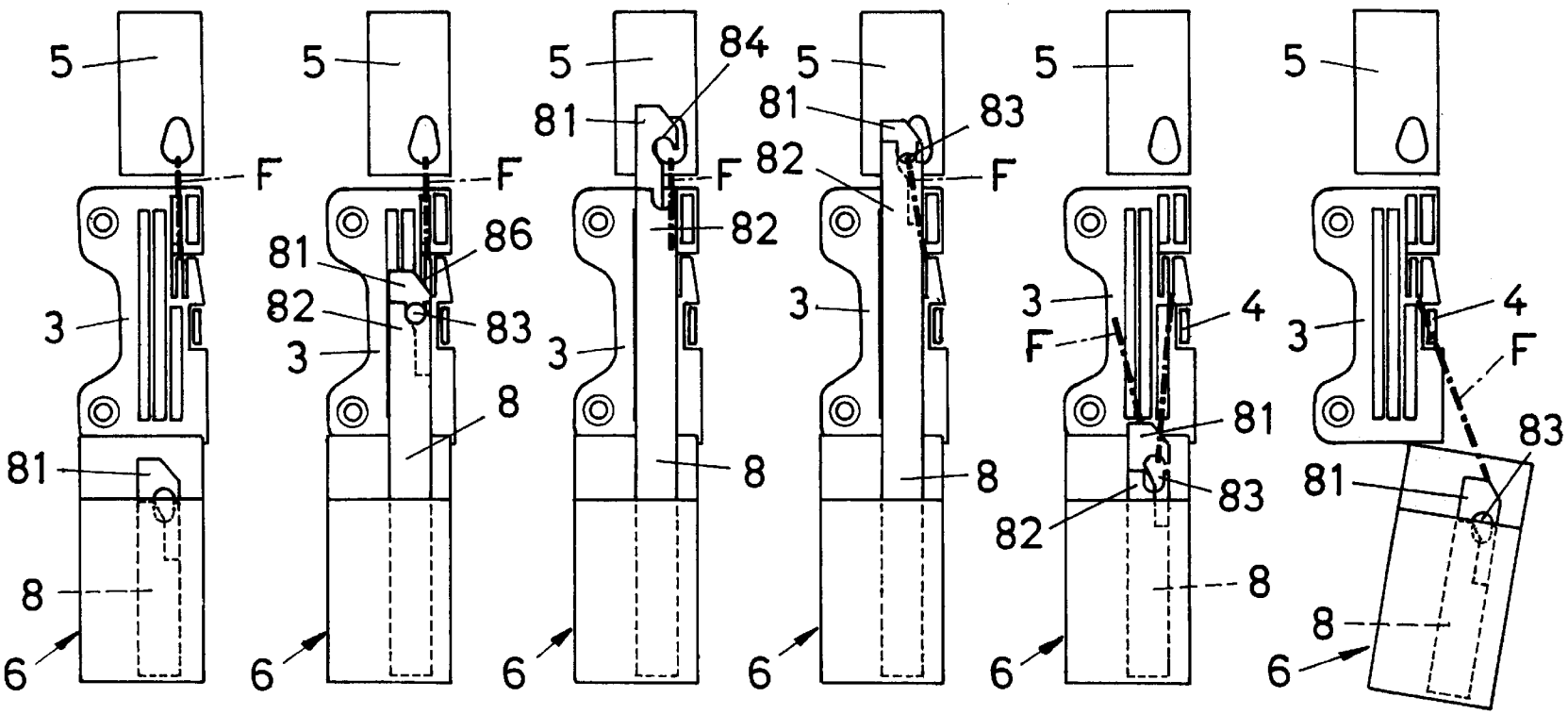
FIGS. 4 to 9 represent various working positions of the auxiliary device when sewing up the starting end of a thread chain, each in a top view.

As can be taken from the working positions shown in FIGS. 4 to 9, the looper nippers 8 have been retracted in the normal position of the thread chain looper to a point before the needle plate 3, and the needle plate 3 is absolutely freely accessible for the sewing operation (FIG. 4). When the workpiece has been sewn and the thread chain F has been held in the suction and separating means 5 and been cut through, the looper nippers 8 together with both nipper portions 81, 82 advance up to the stitch area, where the descending thread is deflected laterally by the thread deflector edge 86 (FIG. 5). When the looper nippers 8 have reached the rear end of the needle plate, the upper nipper portion 82 is retained by a relative movement of adjusting disk 101 and swivelling lever 102, and only the lower nipper portion 81 is advanced until the end piece of the thread chain lies inside the clamping edge 82 and protrudes upwards through the opening of the nipper mouth (FIG. 6). Now, the upper nipper portion 82 is also advanced with respect to the adjusting disk 101 by means of a relative swivel movement of the swivelling lever 102, and the looper nippers 8 are closed, whereupon the end of the thread chain is clamped between the clamping edges 84, 85 (FIG. 7). Now, the looper nippers 8 need merely be retracted by swivelling the adjusting disk 101 and the swivelling lever 102 back into the normal position, and the end of the thread chain is turned round by entraining the same against the sewing direction N, so that sewing the next workpiece can be started (FIG. 8), where opening the nipper mouth 83 provides for a withdrawal of the thread chain. Subsequently, the swivel arm 9 is deflected laterally along with a lateral deflection of the end of the thread chain, and the thread chain F is drawn into the cutting area of the edge cutter 4 (FIG. 9), which cuts the thread chain F into corresponding lengths. The remaining end is sewn in when sewing the applied workpiece, and sewing up the starting end of the thread chain is terminated.

I claim:

1. An auxiliary device for sewing up a starting end of a thread chain in a chain stitch sewing machine comprising a platform, a needle plate, an edge cutter, a suction and separating means disposed behind the needle plate in a sewing direction for taking in and cutting off the thread chain upon sewing a workpiece, a returning means for turning a remaining end of the thread chain around against the sewing direction, and a clamping and deflecting means disposed ahead of the needle plate in the sewing direction for retaining the remaining end of the thread chain turned around and for laterally deflecting the same into a cutting area of the edge cutter, both the returning means and the clamping and deflecting means being constituted by a thread chain looper disposed ahead of the needle plate, and the looper consisting of loop nippers longitudinally movable in the sewing direction and a nipper carrier movable transversely to the sewing direction.

2. The auxiliary device as claimed in claim 1, wherein the looper nippers comprise two nipper portions guided parallel to each other in the longitudinal direction and adjustable relative to each other, which have cooperating clamping edges defining a nipper mouth in the front end portion, which nipper portions with the nipper mouth can be moved from a normal position lying ahead of the needle plate to a suction hole of the suction and separating means behind the needle plate.

3. The auxiliary device as claimed in claim 2, wherein a nipper portion protruding in the sewing direction defines an inclined thread deflector edge at its front end.

4. The auxiliary device as claimed in claim 2, wherein the nipper portions consist of leaf springs, which are downwardly deflected from the upper surface of the platform via a curved guide and act upon an actuator provided on the bottom surface of the platform.

5. The auxiliary device as claimed in claim 4, wherein the actuator has an adjusting lever pivotally mounted relative to the adjusting disk rotatable about a horizontal transverse axis, on whose periphery one of the leaf springs is mounted, and a coaxial adjusting disk acts upon another one of the leaf springs, which is loosely supported on the adjusting disk or on the one leaf spring.

6. The auxiliary device as claimed in claim 1, wherein the nipper carrier accommodating the looper nippers is a horizontally guided cross slide.

7. The auxiliary device as claimed in any of claims 1 to 5, wherein the nipper carrier accommodating the looper nippers is designed as swivel arm pivotally mounted about a vertical axis.

8. The auxiliary device as claimed in claim 7, further comprising a two-part swivel arm with a carrier portion for the looper nippers and a supporting member pivotally mounted thereon for support on the platform.

* * * * *

UNITED STATES PATENT AND TRADEMARK OFFICE

CERTIFICATE OF CORRECTION

PATENT NO. : 6,009,819
DATED : January 4, 2000
INVENTOR(S) : SAHL

It is certified that error appears in the above-indentified patent and that said Letters Patent is hereby corrected as shown below:

On the title page, column 1, Item [73], change the name of the assignee to read:

--Nähtechnik Sahl Ges. m.b.H.--.

Signed and Sealed this

Fourteenth Day of November, 2000

*Attest:*

Q. TODD DICKINSON

*Attesting Officer*

*Director of Patents and Trademarks*